US007568636B2

(12) United States Patent
Saunders et al.

(10) Patent No.: US 7,568,636 B2
(45) Date of Patent: Aug. 4, 2009

(54) DUAL NOZZLE SPRAYER

(75) Inventors: Craig M. Saunders, Rocky River, OH (US); Lindsey Tufts, Jr., Eastlake, OH (US); Charles Peter Althoff, Cleveland Heights, OH (US); Jeffrey Kalman, Cleveland Heights, OH (US); Donald C. Fuchs, Jr., Mentor, OH (US); Michael P. O'Toole, Cleveland Heights, OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 320 days.

(21) Appl. No.: 11/432,903

(22) Filed: May 12, 2006

(65) Prior Publication Data

US 2007/0095939 A1 May 3, 2007

Related U.S. Application Data

(60) Provisional application No. 60/727,735, filed on Oct. 18, 2005.

(51) Int. Cl.

| | |
|---|---|
| ***A62C 5/02*** | (2006.01) |
| *B05B 7/14* | (2006.01) |
| *A62C 31/00* | (2006.01) |
| *B05B 9/00* | (2006.01) |

(52) U.S. Cl. ..... 239/310; 239/336; 239/443; 239/303; 239/304; 239/312

(58) Field of Classification Search ..... 239/336, 239/443, 303, 304, 312, 310

See application file for complete search history.

(56) References Cited

U.S. PATENT DOCUMENTS 556,291 A * 3/1896 Turner ..... 239/441
1,168,612 A * 1/1916 Durning ..... 422/274
1,881,345 A * 10/1932 Beatty et al. ..... 239/422
2,348,334 A * 5/1944 Ellinger ..... 239/312
2,458,220 A * 1/1949 Striegel et al. ..... 239/415
2,529,852 A * 11/1950 Snowden et al. ..... 137/637
3,049,303 A * 8/1962 Gottlieb ..... 239/312
3,111,272 A * 11/1963 Underdown et al. ..... 239/420
3,212,717 A * 10/1965 Scheinert ..... 239/336
3,219,276 A * 11/1965 Norris ..... 239/752
3,399,834 A * 9/1968 Bradley ..... 239/10
3,448,809 A * 6/1969 Cymmer et al. ..... 169/15
3,734,407 A * 5/1973 De Stefano, Jr. ..... 239/13

(Continued)

*Primary Examiner*—Len Tran
*Assistant Examiner*—Steven Cernoch
(74) *Attorney, Agent, or Firm*—Fay Sharpe LLP

(57) ABSTRACT

The present invention relates to a portable sprayer for applying a diluted product to a surface to be treated. The sprayer includes a housing including an inlet for supplying pressurized water to the sprayer, a first water only outlet, and a second diluted product only outlet. A mixing chamber is located within the housing. The mixing chamber is dimensioned to securely hold the product and is in fluid communication with the second outlet. A first flow passage extends through the housing. The first flow passage is in selective fluid communication with the inlet and the first outlet. A second flow passage extends through the housing. The second flow passage is in selective fluid communication with the first flow passage and the mixing chamber. A wall of the second flow passage is configured to direct the pressurized water flowing through the second flow passage into the mixing chamber to evenly dissolve the product and provide a generally consistent product to water ratio.

19 Claims, 13 Drawing Sheets

U.S. PATENT DOCUMENTS 3,802,628 A * 4/1974 Goss et al. ..... 239/302
3,840,179 A * 10/1974 Krohn et al. ..... 239/1
4,220,001 A * 9/1980 Beichel ..... 60/225
4,850,513 A * 7/1989 Porter ..... 222/1
5,160,093 A * 11/1992 Battaglia ..... 239/444
5,186,388 A * 2/1993 Chapman et al. ..... 239/8
5,351,890 A * 10/1994 Clements ..... 239/143
5,375,769 A 12/1994 Schultz
5,595,345 A 1/1997 Chura et al.
5,850,973 A 12/1998 Liljeqvist et al.
5,927,338 A * 7/1999 Boticki et al. ..... 137/888
6,260,772 B1 * 7/2001 Hennemann et al. ..... 239/310
6,378,789 B1 * 4/2002 Seaman et al. ..... 239/443
6,772,966 B2 8/2004 Foster et al.

* cited by examiner

FIGURE 10
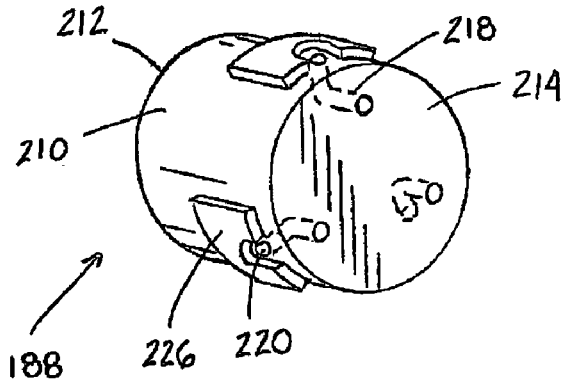
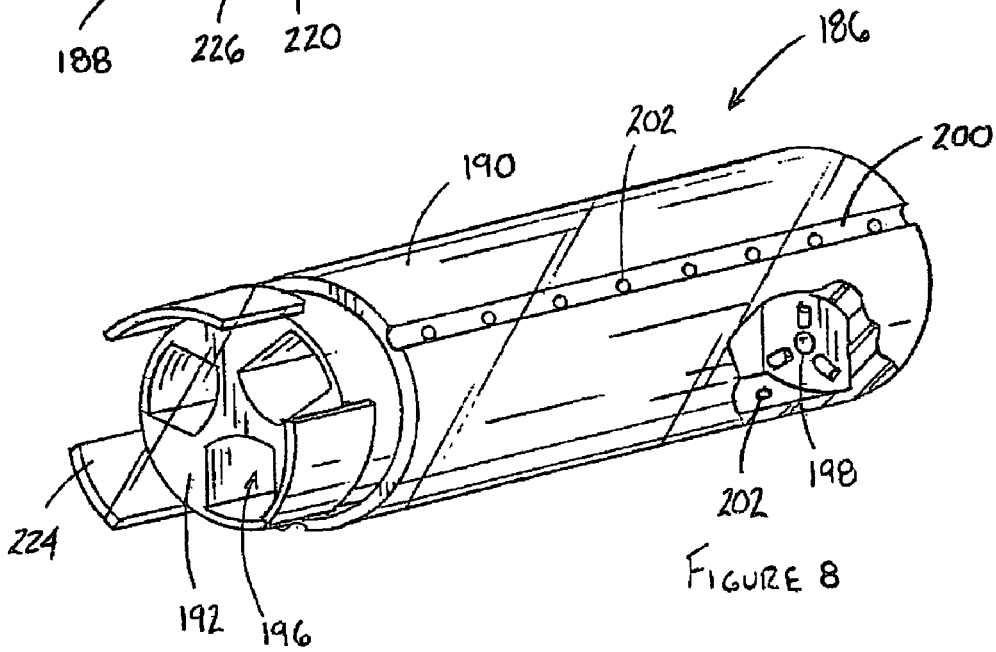
FIGURE 8
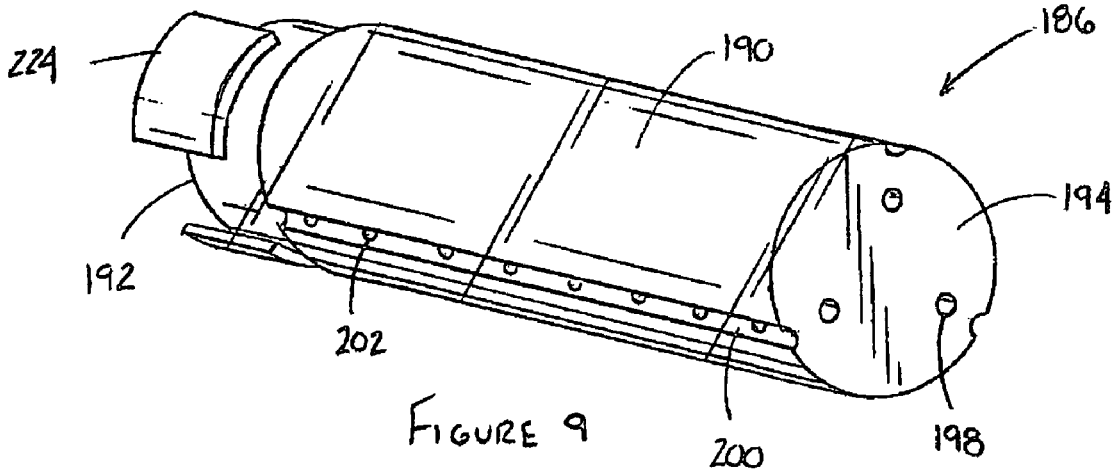
FIGURE 9

DUAL NOZZLE SPRAYER

CROSS REFERENCE TO RELATED APPLICATIONS

This application claims priority from U.S. Provisional Patent Application Ser. No. 60/727,735 filed Oct. 18, 2005 and is incorporated herein by reference.

BACKGROUND OF THE INVENTION

The present invention relates generally to mixing and dispensing sprayers. More particularly, the present invention relates to a sprayer that is attached to the end of a garden hose for use in mixing a water soluble product with water and spraying the diluted product onto a surface to be treated. The sprayer also can be used to apply a water-only rinse to the surface.

A typical hose end sprayer has two connections, one of which is connected to the end of a garden hose that serves as a supply of water under pressure to the sprayer and the second of which is connected to a separate product container to be selectively dispensed from the sprayer. Sprayers of this type are often used in the home garden or yard for dispensing chemicals such as weed killer or fertilizer mixed with the flow of water passing through the sprayer. In addition, sprayers of this type are used with a soap product contained in the separate container where the flow of water mixes with the soap product as it passes through the sprayer. Sprayers of this type are often used to wash automobiles, housing siding, and windows of a home.

Conventional sprayer arrangements vary in complexity and typically spray a water/product mixture or water-only through a common outlet of the sprayer. In the typical operation of these sprayers, the flow of water through the sprayer interior creates a venturi effect in the sprayer that draws the product contained in the product container into the flow of water where it is mixed with the water before being discharged from the sprayer.

Because the sprayers of the type described above are sold as household products that are used to spread chemicals in the home garden or yard or to wash the siding, windows or automobile of the homeowner, it is very desirable that the sprayers be constructed inexpensively and be easy to operate. In addition, it is also desirable that the sprayers provide features that enhance their usefulness without detracting from the ease of operating the sprayers. Further, the sprayers should be capable of delivering a water/product mixture or water-only rinse over a suitable distance.

However, conventional sprayers have been found to be awkward to use. The difficulty in using prior art sprayers most often results from their not being constructed with a distinct handle, and from the attachment of the container to the sprayer. The removable connection of the sprayer to the container requires the container to be separated from the sprayer each time it is necessary to add more product to be dispensed. With the sprayer attached to a garden hose, it is difficult to unscrew the container from the sprayer and often the container is dropped by the user of the device as the container is unscrewed.

In light of the foregoing, it becomes evident that there is a need for a sprayer that would provide a solution to one or more of the deficiencies from which the prior art and/or conventional sprayers have suffered.

BRIEF DESCRIPTION OF THE INVENTION

In accordance with one aspect of the present invention, a portable sprayer for applying a diluted product to a surface to be treated is provided. The sprayer comprises a housing including an inlet for supplying pressurized water to the sprayer, a first water only outlet, and a second diluted product only outlet. A mixing chamber is located within the housing. The mixing chamber is dimensioned to securely hold the product and is in fluid communication with the second outlet. A first flow passage extends through the housing. The first flow passage is in selective fluid communication with the inlet and the first outlet. A second flow passage extends through the housing. The second flow passage is in selective fluid communication with the first flow passage and the mixing chamber. A wall of the second flow passage is configured to direct the pressurized water flowing through the second flow passage into the mixing chamber to evenly dissolve the product and provide a generally consistent product to water ratio.

In accordance with another aspect of the present invention, a portable sprayer for applying a diluted product to a surface to be treated comprises a mixing container and a plumbing assembly mounted to the mixing container. The mixing container includes at least one channel adapted to securely retain therein the product. The plumbing assembly includes a first flow member, a second flow member and a third flow member. The first flow member defines a first flow passage having an inlet in fluid communication with a source of pressurized water and an outlet. The second flow member defines a second flow passage having an inlet in fluid communication with the outlet of the first flow passage and an outlet. The third flow member defines a third flow passage having an inlet in fluid communication with the outlet of the second flow passage and at least one outlet port. The at least one outlet port extends into the mixing housing. The at least one outlet port directs the pressurized water flowing through the third flow passage into the at least one channel of the mixing housing to evenly dissolve the associated product at a substantially constant dissolution.

In accordance with yet another aspect of the present invention, a portable dual nozzle sprayer for applying a diluted product to a surface to be treated comprises a dilution housing and a plumbing assembly operably connected to the dilution housing. The dilution housing includes a plurality of channels. Each channel is adapted to securely retain therein the associated product. The plumbing assembly includes a first flow tube and a second flow tube. The first flow tube defines a first flow passage having an inlet in fluid communication with a source of pressurized water and an outlet. The second flow tube defines a second flow passage having an inlet in fluid communication with the outlet of the first flow tube and a plurality of spaced apart outlet ports. Each outlet port extends into one of the plurality of channels. The outlet ports jet the pressurized water flowing through the second flow passage into the plurality of channels to evenly dissolve the associated product. A first spray pattern member is in fluid communication with the outlet of the first flow tube for spraying pressurized water. A second spray pattern member is in fluid communication with the plurality of outlet ports of the second flow tube for spraying diluted associated product.

Still other aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

FIG. 8 is a perspective view of a flow tube, partially broken away, of the dual nozzle sprayer of FIG. 7.

FIG. 9 is a perspective view of the flow tube of the dual nozzle sprayer of FIG. 8.

FIG. 10 is a front perspective view of a manifold of the dual nozzle sprayer of FIG. 7.

DETAILED DESCRIPTION OF THE INVENTION

It should, of course, be understood that the description and drawings herein are merely illustrative and that various modifications and changes can be made in the structures disclosed without departing from the scope and spirit of the invention. Like numerals refer to like parts throughout the several views.

Figure 1:
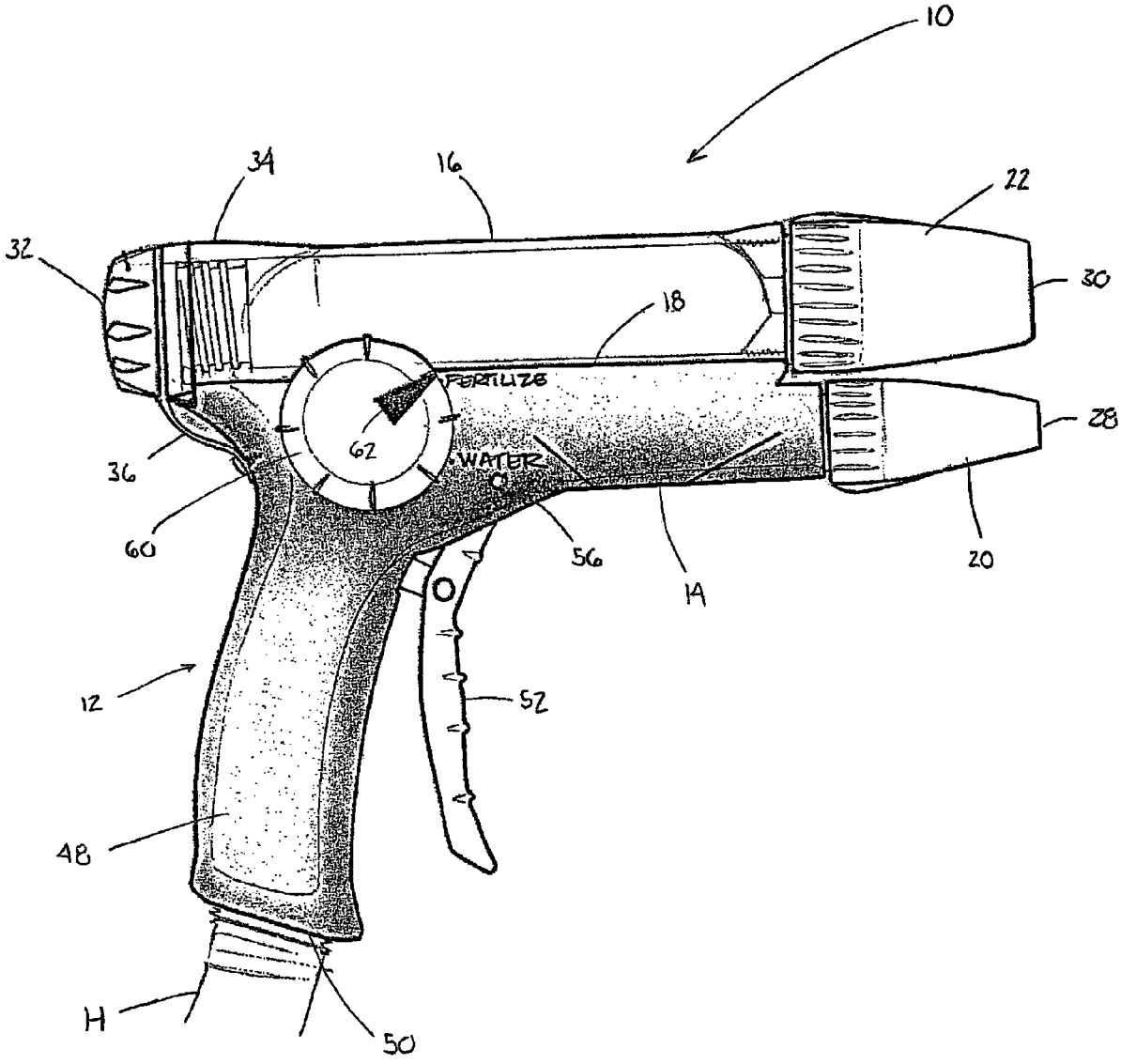
FIG. 1 is a side view of a dual nozzle sprayer according to a first embodiment of the present invention.
Figure 2:
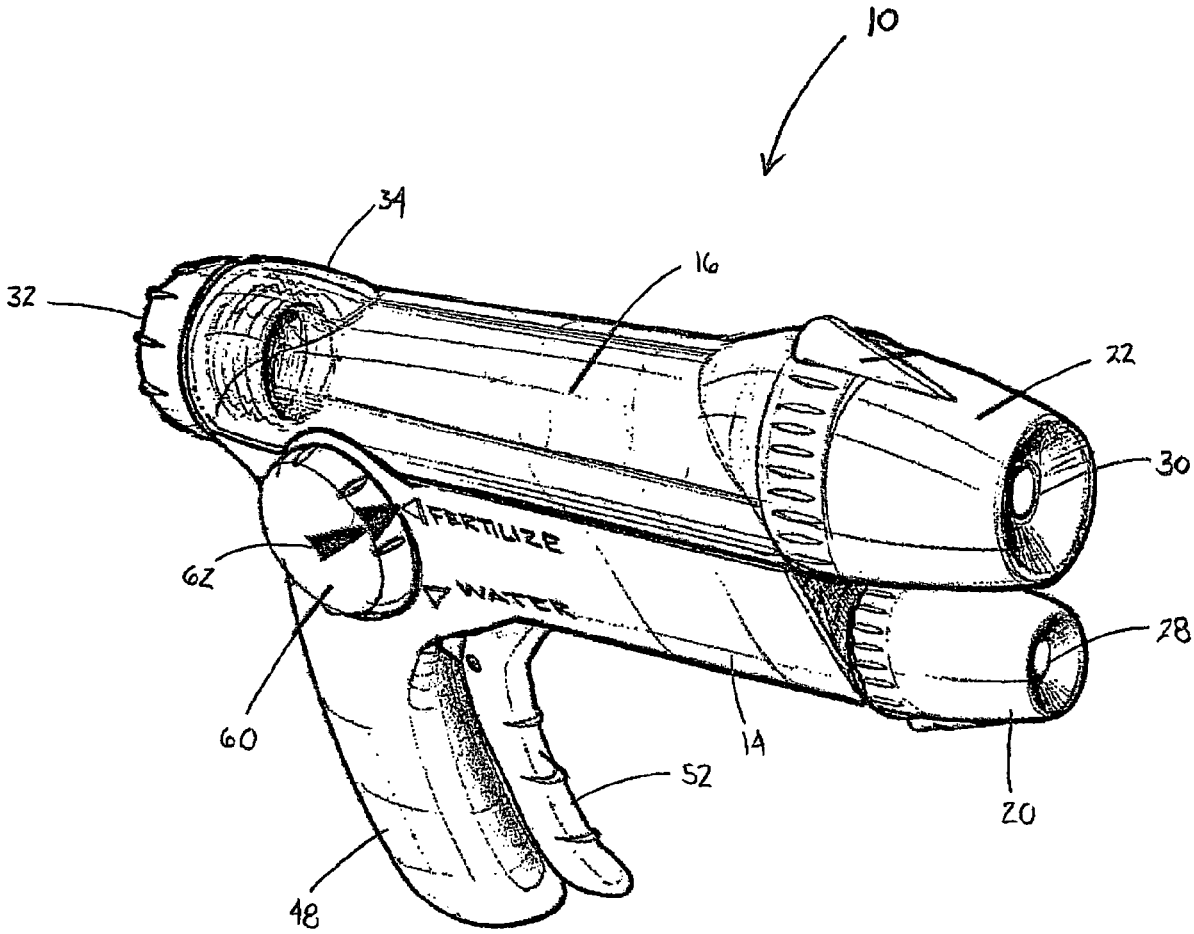
FIG. 2 is a side perspective view, partially broken away, of the dual nozzle sprayer of FIG. 1.
Figure 3:
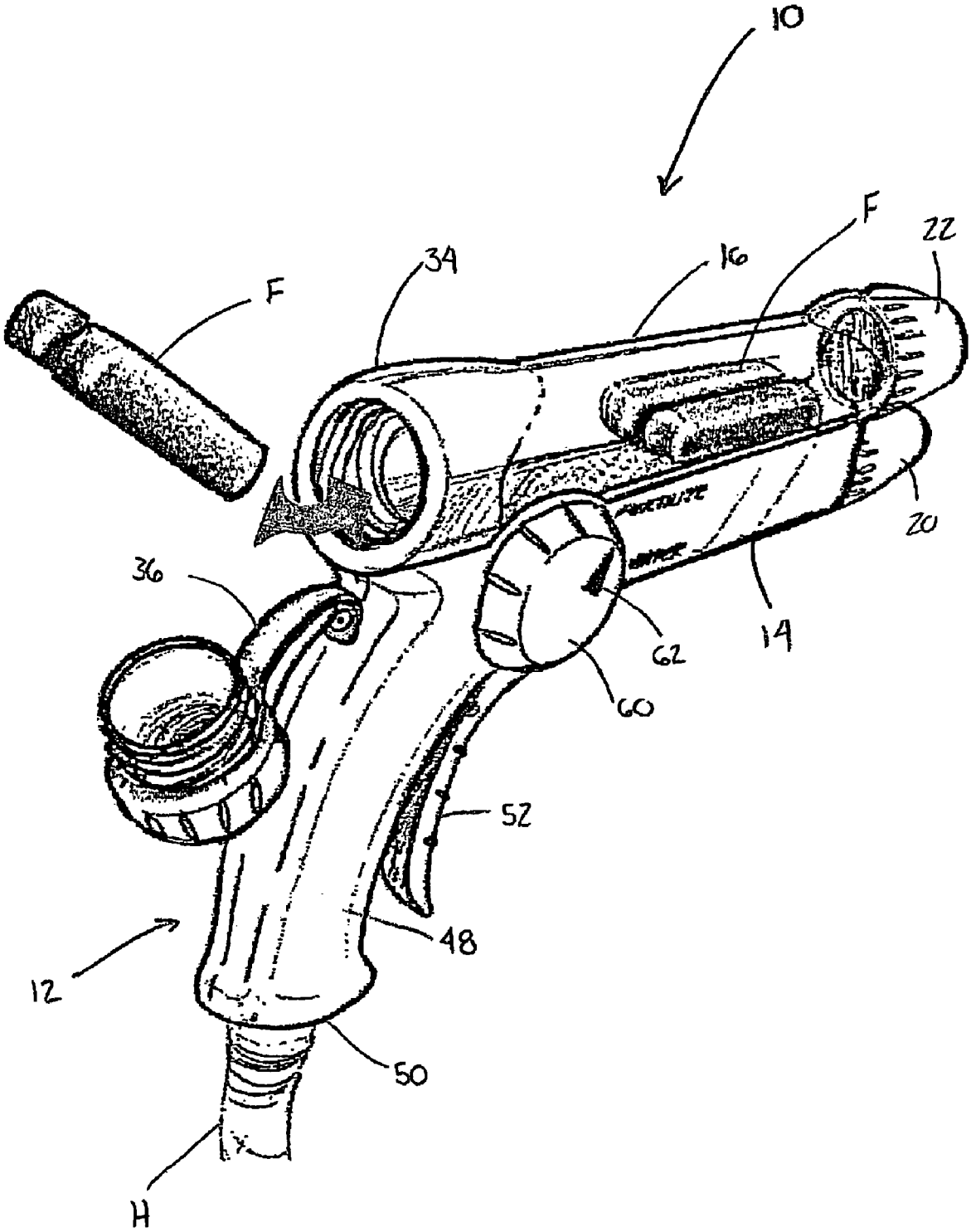
FIG. 3 is a rear perspective view, partially broken away, of the dual nozzle sprayer of FIG. 1 showing the placement of soluble product.

Referring now to the drawings, wherein the showings illustrate several embodiments of the present invention only and are not intended to limit same, FIGS. 1-3 show a portable dual nozzle sprayer 10 according to a first embodiment which is adapted for ergonomic dispensing of a mixture of a soluble product with water onto a surface to be treated. While the invention is illustrated as a dual nozzle sprayer for a fertilizer, it should be appreciated that the invention can be adapted for a wide variety of other soluble products as well. Thus, the dual nozzle sprayer 10 disclosed herein could be used for dispensing other soluble products to be mixed with the flow of pressurized water passing through the sprayer such as weed killer, pesticides, soap, waxes, and other-like chemicals.

With reference to FIGS. 1-3, the dual nozzle sprayer 10 generally includes a body portion 12, a first flow member 14 and a second flow member 16. In the depicted embodiment, each flow member has a generally cylindrical, tubular conformation; although, this is not required. Other shapes can be contemplated as well. The first flow member is generally parallel to the second flow member. In this embodiment, the second flow member is positioned on top of the first flow member and a common wall 18 separates the first and second flow members. The first flow member 14 defines a first flow passage and includes a water-only inlet and a water-only outlet. The second flow member 16 defines a second flow passage and includes a water-only inlet and a diluted product outlet. While the first flow member is illustrated as being generally smaller in cross-section than the second flow member, it should be appreciated that the relative sizes of the flow members are not germane to the present invention.

The dual nozzle sprayer 10 further includes a first spray pattern member or first flow adjustment nozzle 20 and a second spray pattern member or second flow adjustment nozzle 22. The first nozzle 20 includes an inlet in fluid communication with the water-only outlet of the first flow member and an outlet 28. The second nozzle 22 includes an inlet in fluid communication with the diluted product outlet of the second flow member and an outlet 30. The first and second flow adjustment nozzles 20 and 22 extend from the first and second flow members 14 and 16, respectively. In this embodiment, the nozzles are rotatably secured to the flow members. In particular, each flow adjustment nozzle can contain an annular seal and can be formed with internal screw threads for attaching the inlet end of each nozzle to a fitting (not shown) extending from each flow member 14, 16 having complimentary screw threads. It should be appreciated that other methods of attaching the nozzles 20 and 22, such as snap fittings, compression fittings, and the like, could be substituted for the internal threads.

It should be appreciated that by rotating the first and second flow adjustment nozzles 20, 22, the spray pattern of the flow of water-only or diluted product projecting through the nozzle outlets 28, 30 can be controlled. It should also be appreciated that outlets 28, 30 can have different shapes and/or sizes to selectively provide desired spray patterns for the water-only and diluted product sprayed from the sprayer. For instance, by proper choice of the outlet size and/or shape, it is possible to apply the diluted product in a wide pattern and/or with moderate impact force on a surface to be coated with the diluted product. On the other hand, since the water-only rinse is applied through a separate outlet 28, it is possible to apply the water-only rinse to the surface with a more narrow spray pattern and/or with greater impact force compared to the diluted product spray pattern.

As shown in FIG. 3, a cap 32 is attached to an opposing end portion 34 of the second flow member 16. The cap can also contain an annular seal and is formed with external screw threads for threadedly engaging complimentary internal screw threads of the opposing end portion. A tether 36 has one end secured to the cap 32 and the other end secured to the body portion 12 near the opposing end portion 34. As the cap 32 is unscrewed from the opposing end portion 34, the tether prevents the cap from being misplaced by conveniently hanging the cap adjacent the opposing end portion. The cap 32 allows the operator of the sprayer 10 to easily insert a soluble product, such as the illustrated fertilizer F, into the second flow member 16.

With continued reference to FIGS. 1-3, the body portion 12 includes a generally hollow handle portion 48 which may have a rubberized texture for operator comfort. The handle portion includes a third flow member (not shown). The third flow member defines a third flow passage and includes an inlet 50 and an outlet in fluid communication with the water only inlet of the first flow member. At least one of the handle portion and the third flow member can have internal screw threads or a rotatable fitting for attaching the sprayer 10 to a source of pressurized water such as a garden hose H. Other methods of attaching the garden hose H, such as snap fittings, compression fittings, and the like, are also contemplated. A suitable screen can be positioned over the inlet 50 to prevent foreign matter from entering the third flow passage which may cause the sprayer 10 to become clogged.

A trigger lever 52 can be pivotally secured to the body portion 12 by a pivot pin 56 adjacent the handle portion 34. The trigger lever can have a pistol grip and can be readily and conveniently grasped by the operator. When the garden hose H is connected to the handle portion 48 and the trigger level is actuated, water will flow through the third flow passage. As is well known, the flow of water through the handle portion 48 is controlled by a first valve member (not shown) which is actuated by the trigger lever 52. Thus, the trigger level 52, when pulled towards the handle portion 48, selectively opens the first valve member whereupon water can flow through at least one of the first and second flow passages defined by the respective first and second flow members 14 and 16.

With the dual nozzle outlet arrangement of the present invention, it is desirable to utilize a multi-position second valve member (not shown) for selectively applying the water-only or diluted product to the respective outlets 28, 30 of the first and second flow nozzles 20, 22. The second valve member may comprise a ball valve, butterfly valve, or valves of conical or cylindrical configuration; all of which are well known in the art. Preferably, the second valve member is of simple, reliable construction, fabricated of relatively inexpensive material, such as plastic, or the like. A requirement for the second valve member is that it be manually manipulatable, externally of the body portion 12. The second valve member is movable to a plurality of positions by a diverter 60. In a first position, an indicator 62 located on the diverter is pointed to a water indicia on the body portion 12 whereby outlet 28 is supplied water-only and outlet 30 is prevented from spraying diluted product. In a second position, the indicator 52 is pointed to a product indicia on the body portion 12 whereby outlet 30 is supplied diluted product and outlet 28 is prevented form spraying water-only. It should be appreciated that the second valve member can have a third position whereby both outlets 28, 30 are prevented from spraying water-only or diluted product. It should also be appreciated that the second valve member can have intermediate positions whereby outlet 28 is supplied water-only and outlet 30 is supplied diluted product. Thus, second valve member allows the operator to regulate volume of water flow through the first and second flow members 14 and 16.

A better understanding of the dual nozzle sprayer 10 as well as its unique features will be had by description of its operation. A source of water, such as from the garden hose H, is connected to one of the handle portion 48 and the third flow member. A soluble product, such as the fertilizer F, is positioned in the second flow member 16. To spray the diluted product on a surface, the diverter 60 is rotated to the fertilizer indicia thereby placing the second valve member in its above described second position as viewed in FIG. 1. In this second position, no water will flow through the first flow passage of the first flow member 14. The sprayer 10 is held in the operators hand by the handle portion 48 and the trigger lever 52 is then actuated to open the first valve member whereupon high pressure water passes through the third flow passage of the handle portion. It should be appreciated that any air trapped within the second flow member 16 may be released by manipulation of trigger lever 42 of the sprayer. Water flows through the second flow passage of the second flow member 16 and the second spray nozzle 22. The water dilutes the soluble product as it is sprayed. The concentration of the diluted product being sprayed can be controlled by manipulating the second valve member via the diverter 60 as previously described.

As to a further discussion of the manner of usage and operation of the dual nozzle sprayer 10 for water-only spraying, the same should be apparent from the above description relative to the diluted product spraying. Accordingly, no further discussion relating to the manner of usage and operation will be provided.

Figure 5:
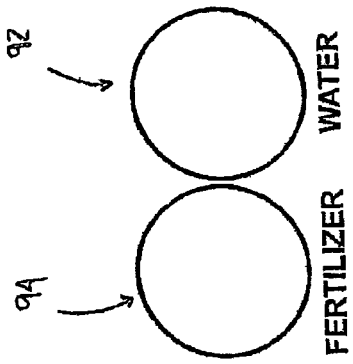
FIG. 5 is a schematic showing the relative position of first and second tubular members of the dual nozzle sprayer of FIG. 4.
Figure 4:
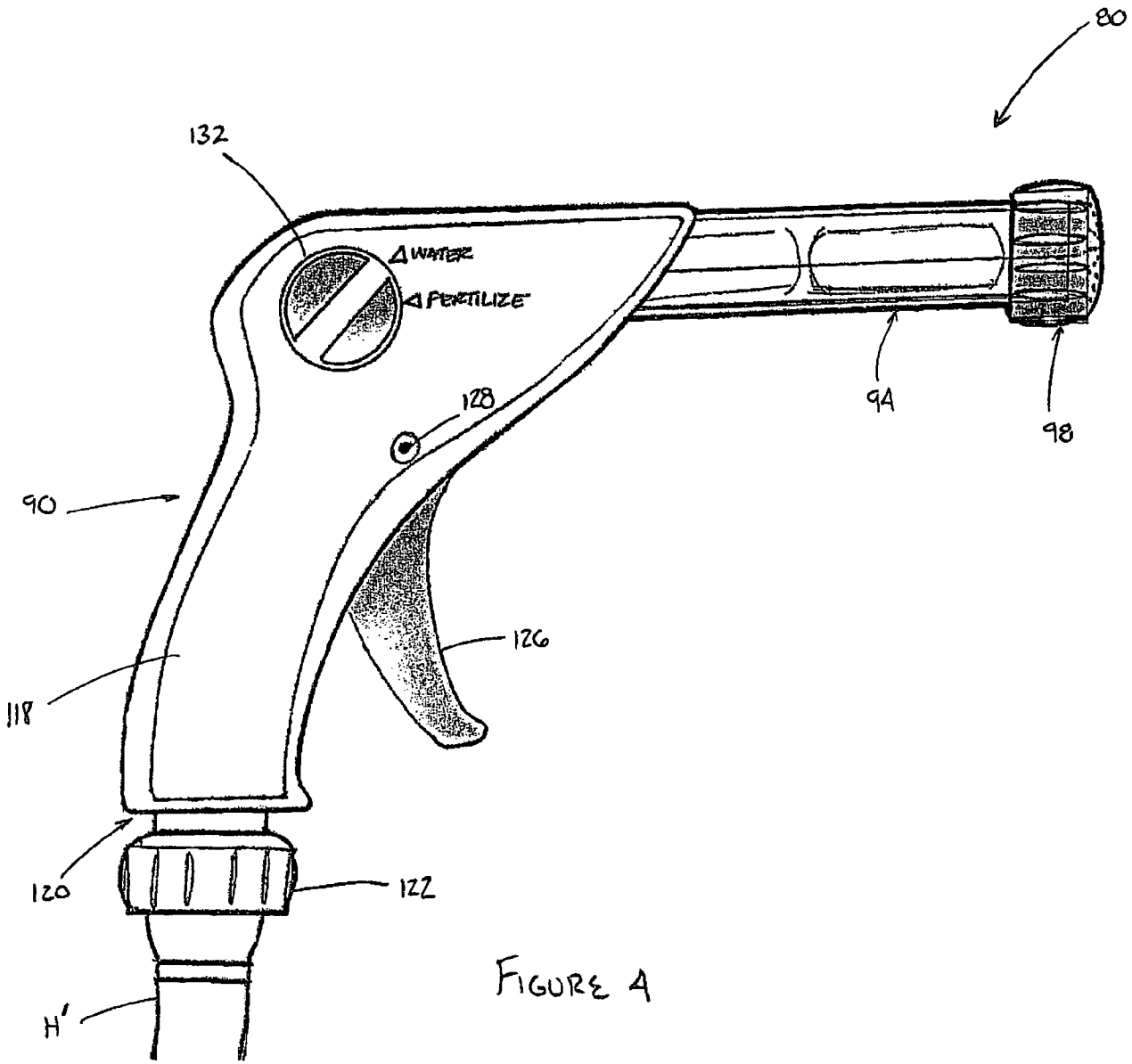
FIG. 4 is a side view of a dual nozzle sprayer according to a second embodiment of the present invention.
Figure 6:
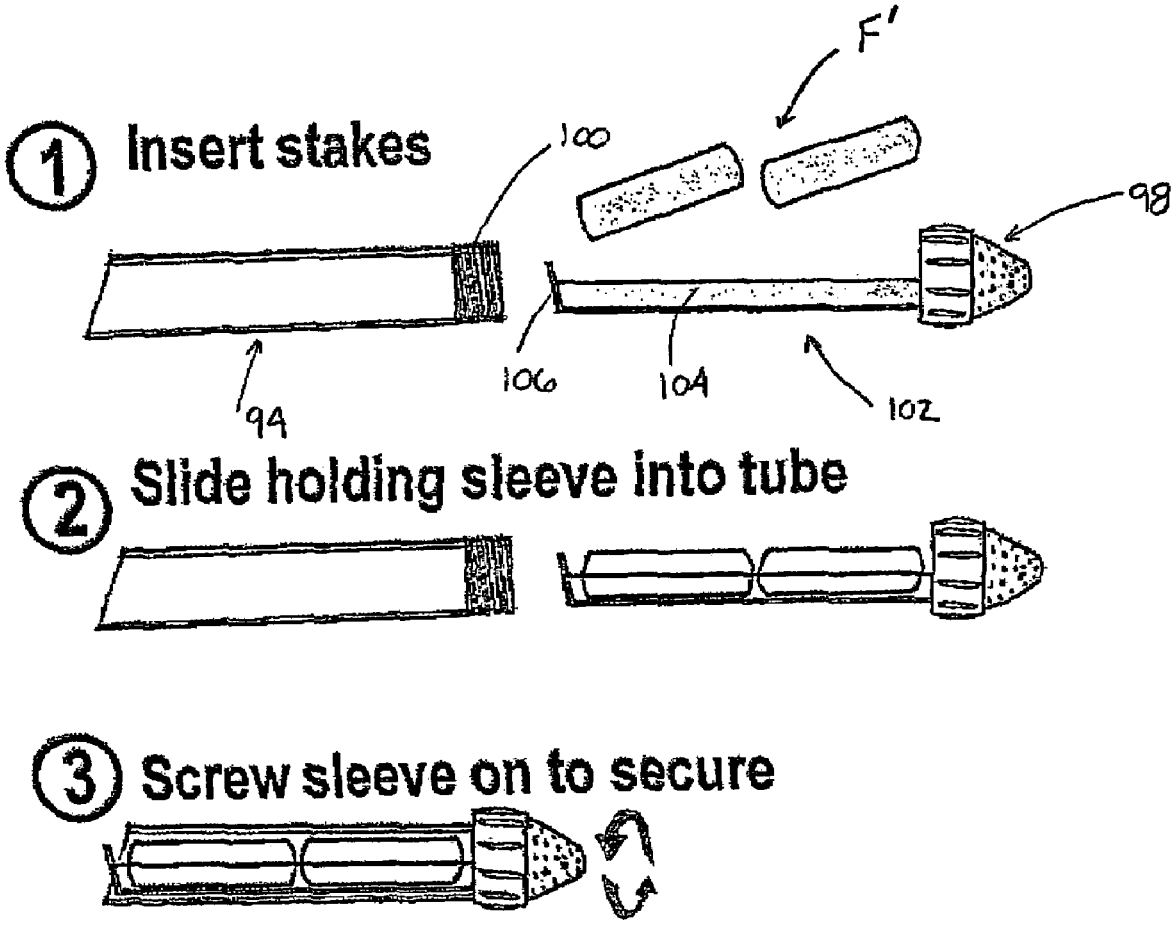
FIG. 6 is an instructional diagram showing the insertion of soluble products in a tubular member of the dual nozzle sprayer of FIG. 4.

Similar to the aforementioned embodiment, a second embodiment of a dual nozzle sprayer is shown in FIGS. 4-6.

With reference to FIGS. 4-6, dual nozzle sprayer 80 generally includes a body portion 90, a first generally flow member (not shown) and a second generally flow member 94, the first flow member being generally parallel to the second flow member. In this embodiment, the second flow member is positioned adjacent to the first flow member (i.e., a side-by-side configuration).

The dual nozzle sprayer 80 further includes a first flow adjustment nozzle (not shown) and a second flow adjustment nozzle 98. The first and second flow nozzles can extend from the first and second flow members. In this embodiment, the nozzles are rotatably secured to the flow members. With reference to FIG. 6, each flow adjustment nozzle can contain an annular seal and is formed with internal screw threads for attaching the inlet end of each nozzle to a fitting 100 extending from each flow member having complimentary screw threads. A holding sleeve 102 can be secured to the second flow nozzle 98. The holding sleeve includes a pair of side walls 104 and an end wall 106. The side walls and the end wall form a cradle which is dimensioned to receive a soluble product, such as the illustrated fertilizer F'. To add fertilizer, the second nozzle 98 is unscrewed from the second flow member 94. The fertilizer is placed in the holding sleeve 102. The holding sleeve is then slid back into the second flow member 94. The second nozzle is then secured back onto the second flow member.

Similar to the first embodiment and with continued reference to FIG. 4, the body portion 90 includes a generally hollow handle portion 118. The handle portion includes an inlet 120 which has a rotatable fitting 122 for attaching the garden hose H' to the sprayer 80. A trigger lever 126 can be pivotally secured to the body portion 90 by a pivot pin 128 for actuating a first valve member (not shown) which controls the flow of water through the handle portion 118. A multi-position second valve member (not shown) selectively applies the water-only or diluted product to the first and second flow nozzles. The second valve member is movable to several flow positions by a diverter 132, the operation of which being fully described with respect to the first embodiment.

As to a further discussion of the manner of usage and operation of the second embodiment, the same should be apparent from the above description relative to the first embodiment. Accordingly, no further discussion relating to the manner of usage and operation will be provided.

Similar to the aforementioned embodiments, a third embodiment of a dual nozzle sprayer is shown in FIGS. 7-10.

Figure 7:
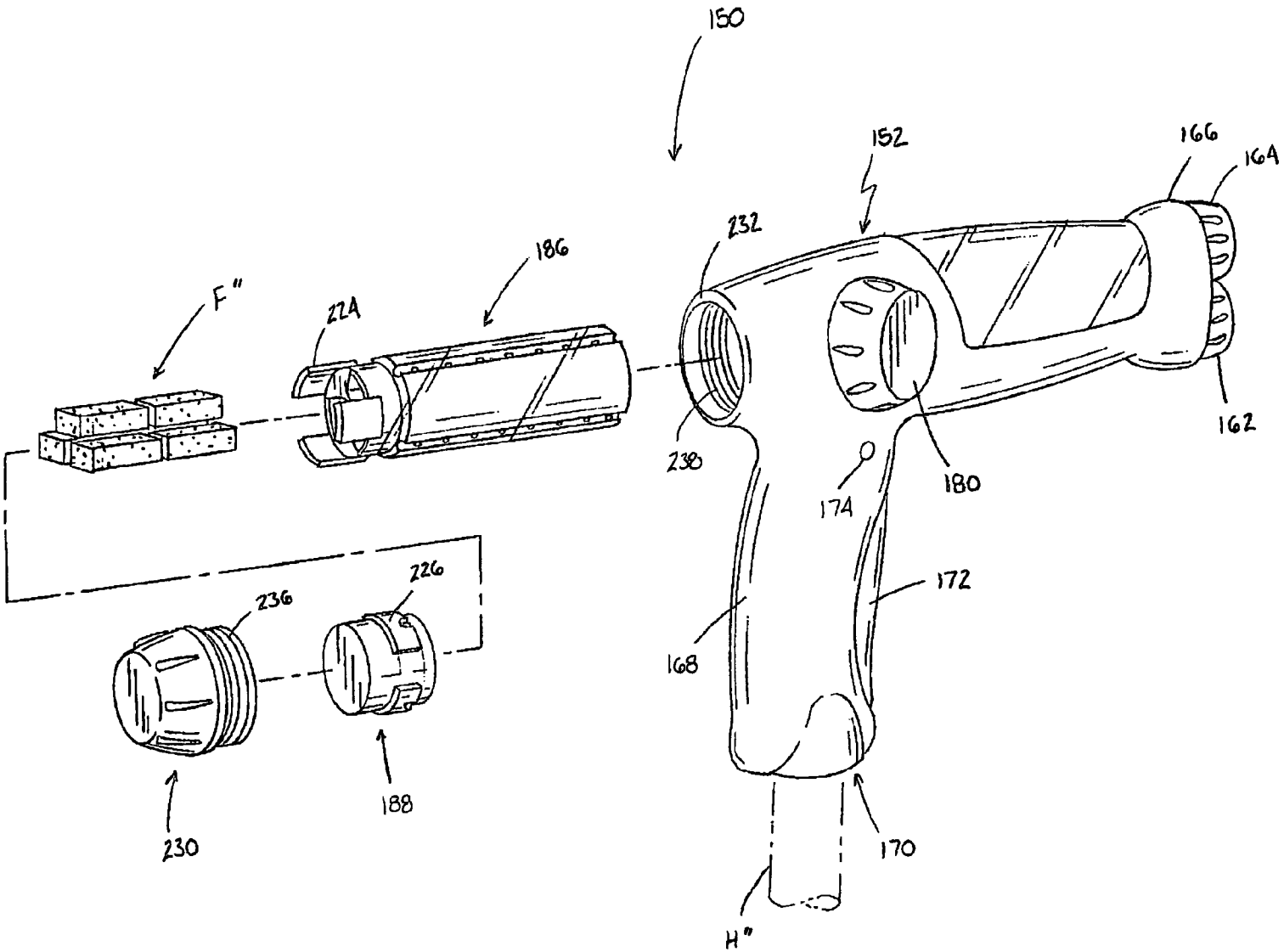
FIG. 7 is an exploded side perspective view of a dual nozzle sprayer according to a third embodiment of the present invention.

With reference to FIG. 7, dual nozzle sprayer 150 generally includes a body portion 152 and a first and second flow members (not shown) housed in the body portion, the first flow member being generally parallel to the second flow member. The first flow member defines a first flow passage and includes a water-only inlet and a water-only outlet. The second flow member defines a second flow passage and includes a water-only inlet and a diluted product outlet.

The dual nozzle sprayer 150 further includes a first spray pattern member or first flow adjustment nozzle 162 and a second spray pattern member or second flow adjustment nozzle 164. Each flow nozzle extends from an end 166 of the body portion. The flow adjustment nozzles can be secured to one of the body portion and the first and second flow members via conventional means such that the first flow adjustment nozzle is in fluid communication with the first flow passage and the second flow adjustment nozzle is in fluid communication with the second flow passage. It should be appreciated by one skilled In the art that by rotating the first and second flow adjustment nozzles 162, 164, the spray pattern of the flow of water-only or diluted product projecting through the nozzle outlets can be controlled.

Similar to the previous embodiments, and with continued reference to FIG. 7, the body portion 152 includes a generally hollow handle portion 168. The handle portion includes a third flow member. (not shown) defining a third flow passage having an inlet 170. The handle portion may have a rubberized texture for operator comfort. To secure the dual nozzle sprayer 150 to a source of water such as a garden hose H", one of the handle portion and the third flow member can include conventional attaching means such as internal screw threads or a rotatable fitting.

A trigger lever 172 can be pivotally secured to the body portion 152 by a pivot pin 174 for actuating a first valve member (not shown) which controls the flow of water through the third flow passage of the handle portion 168. A multi-position second valve member (not shown) selectively applies the water-only or diluted product to the first and second flow passages. The second valve member may comprise a ball valve, butterfly valve, or valves of conical or cylindrical configuration; all of which are well known in the art. The second valve member is movable by a diverter 180, the operation of which being fully described with respect to the first embodiment. The second valve member allows the operator to regulate volume of water flow through the first and second flow members, selectively discharge a flow of water or a mixture of water and product from the sprayer, and control the ratio of water to product.

As shown in FIG. 7, the dual nozzle sprayer 150 further includes a mixing container or flow tube 186 and a manifold 188. As will be described in greater detail below, the flow tube and manifold are positioned in the second flow member to provide a more consistent dissolution of the fertilizer F" within the second flow member.

With reference now to FIGS. 8 and 9, the flow tube 186 is generally cylindrical in cross-section and has a longitudinal axis generally parallel to a longitudinal axis of the second flow member. The flow tube includes an outer surface 190 and first and second end walls 192 and 194, respectively. At least one channel 196 extends longitudinally through the flow tube 186. The channel includes an inlet located on the first end wall 192 and an outlet or exhaust port 198 located on the second end wall 194 The channel is dimensioned to securely hold the fertilizer F" within the flow tube. As such, the fertilizer can not tumble randomly within the second flow member 158 which allows for more consistent dissolution times. Disposed on the outer surface 190 of the flow tube is at least one longitudinally extending flow passage or groove 200. The groove includes a plurality of spaced apart openings or water ports 202 which extend into the channel 198. The openings are generally arrayed along a length of the groove. In the depicted embodiment, the flow tube 186 includes three spaced apart channels 196 and three corresponding grooves 200. Of course, more or less than three channels and grooves could be employed for the flow tube. As pressurized water flows through the second flow passage of the second flow member, the openings direct or jet a portion of the pressurized water into the channels. These water jets act to evenly dissolve the fertilizer F" secured in the mixing container or flow tube 186 which provides a more consistent fertilizer to water ratio. Although dissolution time can vary at different water pressures, the dual nozzle sprayer regulates itself to the varying water pressures to maintain the dissolution rate of the fertilizer. It should also be appreciated that the dissolution rate of the fertilizer inside the channels can be controlled via the addition and/or subtraction of the number of openings 202 into each channel.

With reference now to FIG. 10, the manifold 188, which is also generally cylindrical in cross-section, includes an outer surface 210 and first and second end walls 212 and 214, respectively. At least one bore 218 extends through a portion of the manifold. The bore has an inlet 220 located on the outer surface 210 and an outlet 222 located on the second end wall 214. As shown in FIG. 7, the outlet of the bore is generally aligned with the inlet of at least one of the channels 190 of the flow tube 186. In this embodiment, the manifold 188 includes three spaced apart bores 218, one bore for each corresponding channel 190. Of course, more or less than three bores can be employed for the manifold. Each bore directs a portion of the pressurized water flowing through the second flow member 158 to the inlet of each corresponding channel 190.

With reference again to FIG. 7, the manifold 188 is releasably secured to the flow tube 186. Specifically, the flow tube includes circumferentially spaced apart tabs 224 which are secured to the outer surface 190 and extend outwardly from the first end wall 192. The manifold 188 includes circumferentially spaced apart shelves 226. To secure the manifold to the flow tube, the tabs 224, which have an inner diameter slightly larger than the outer diameter of the manifold, are positioned in the space between the shelves thereby creating a frictional engagement between the tabs and the outer surface 210 of the manifold 188. Once secured, the second end wall 214 of the manifold 188 abuts against the first end wall 192 of the flow tube 186.

The dual nozzle sprayer 150 further includes a cap 230 which can be attached to an end portion 232 of the body portion 152. The cap can contain an annular seal and is formed with external screw threads 236 for threadedly engaging complimentary internal screw threads 238 of the end portion. As shown in FIG. 7, the threaded portion of the cap 230 can surround a portion of the manifold 188. The cap allows the operator of the sprayer 150 to easily remove the manifold and flow tube and insert a soluble product, such as the illustrated fertilizer F", into the channels 190 of the flow tube.

A better understanding of the dual nozzle sprayer 150 as well as its unique features will be had by description of its operation. A source of water, such as from the garden hose H", is connected to the handle portion 168. A soluble product, such as the fertilizer F", is positioned in the channels 190 of the flow tube 186. The manifold 188 is then secured to the flow tube in the manner described above. The cap 230 is secured to the opposing end portion of the manifold. The flow tube and the manifold are then inserted into the second flow member 158 and the cap is threadedly attached to the end portion 232 of the body 152. Once inserted, the second end wall 194 of the flow tube is adjacent an outlet of the second flow member 158.

To spray the diluted product onto a surface, the diverter 180 is rotated thereby placing the second valve member in a diluted product position as more fully described with respect to the first embodiment. In this position, pressurized water is prevented from flowing through the first flow member 156. The sprayer 150 is held in the operator's hand by the handle portion 168 and the trigger lever 172 is then actuated to open the first valve member whereupon high pressure water passes through the third flow member of the handle portion and into the second flow member 158. Because the second end wall 194 of the flow tube 186 is adjacent the outlet of the second flow member 158, the pressurized water is at least partially prevented from flowing directly out of the outlet of the second flow member. The pressurized water is forced to flow through the bores 218 of the manifold 188 and into the channels 190. The water is also forced to flow through the grooves 200 into the openings 202 of the flow tube 186 and into the channels 190. It should be appreciated that the flow of water through the bores and openings also increases the velocity of the water through the second flow member 158. Again, the openings 202, which act as water jets, evenly dissolve the fertilizer F" secured in the flow tube. The diluted water is directed through the exhaust ports 198 located on the second wall 194 of the flow tube 186 and flows out of the second spray nozzle 164. The concentration of the diluted product being sprayed can be controlled by turning the diverter 180 as previously described.

As to a further discussion of the manner of usage and operation of the dual nozzle sprayer 150 for water-only spraying, the same should be apparent from the above description relative to the first embodiment. Accordingly, no further discussion relating to the manner of usage and operation will be provided.

Similar to the aforementioned embodiments, a fourth embodiment of a dual nozzle sprayer is shown in FIGS. 11-18.

Figure 11:
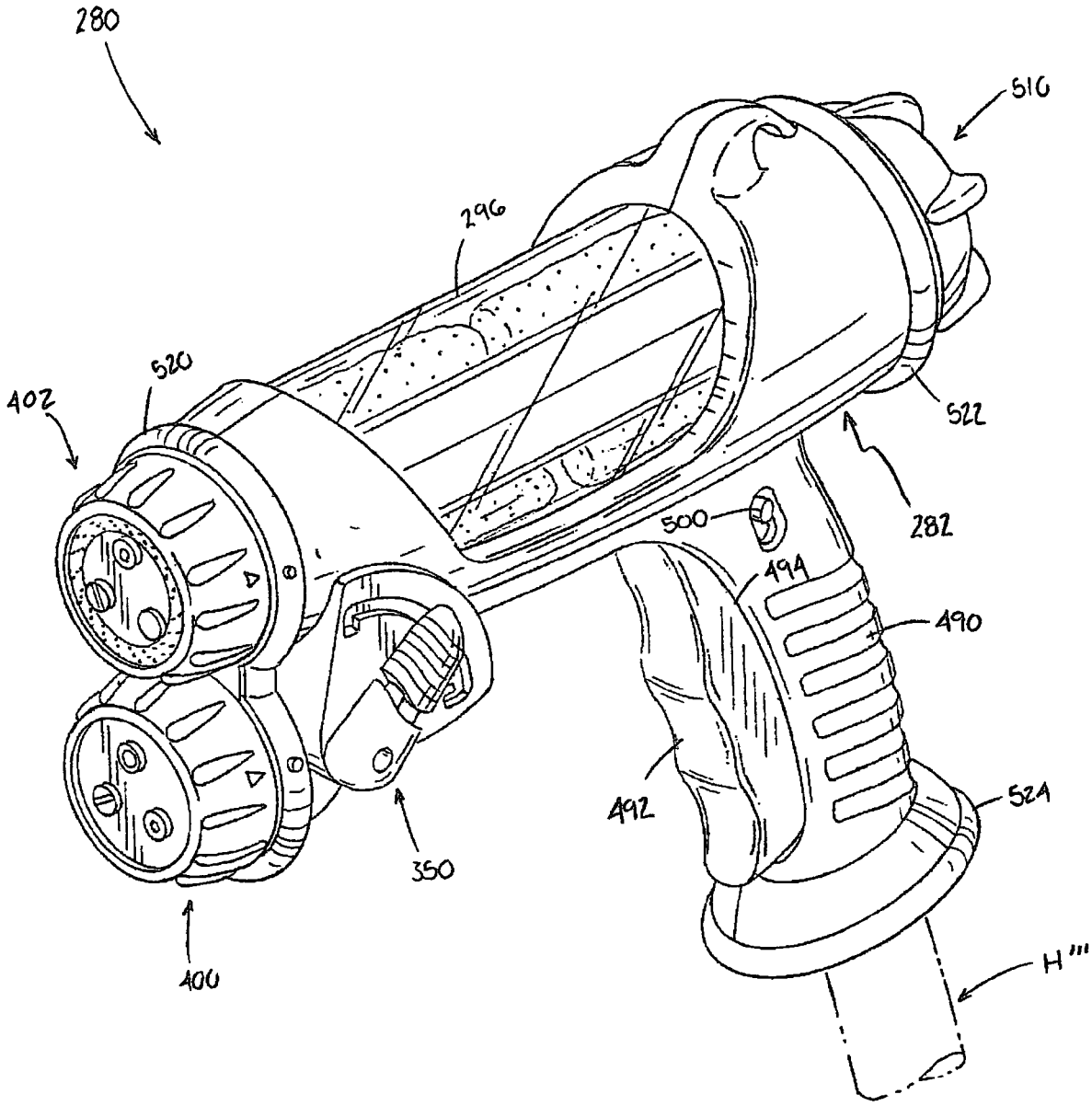
FIG. 11 is a side perspective view of a dual nozzle sprayer according to a fourth embodiment of the present invention.
Figure 12:
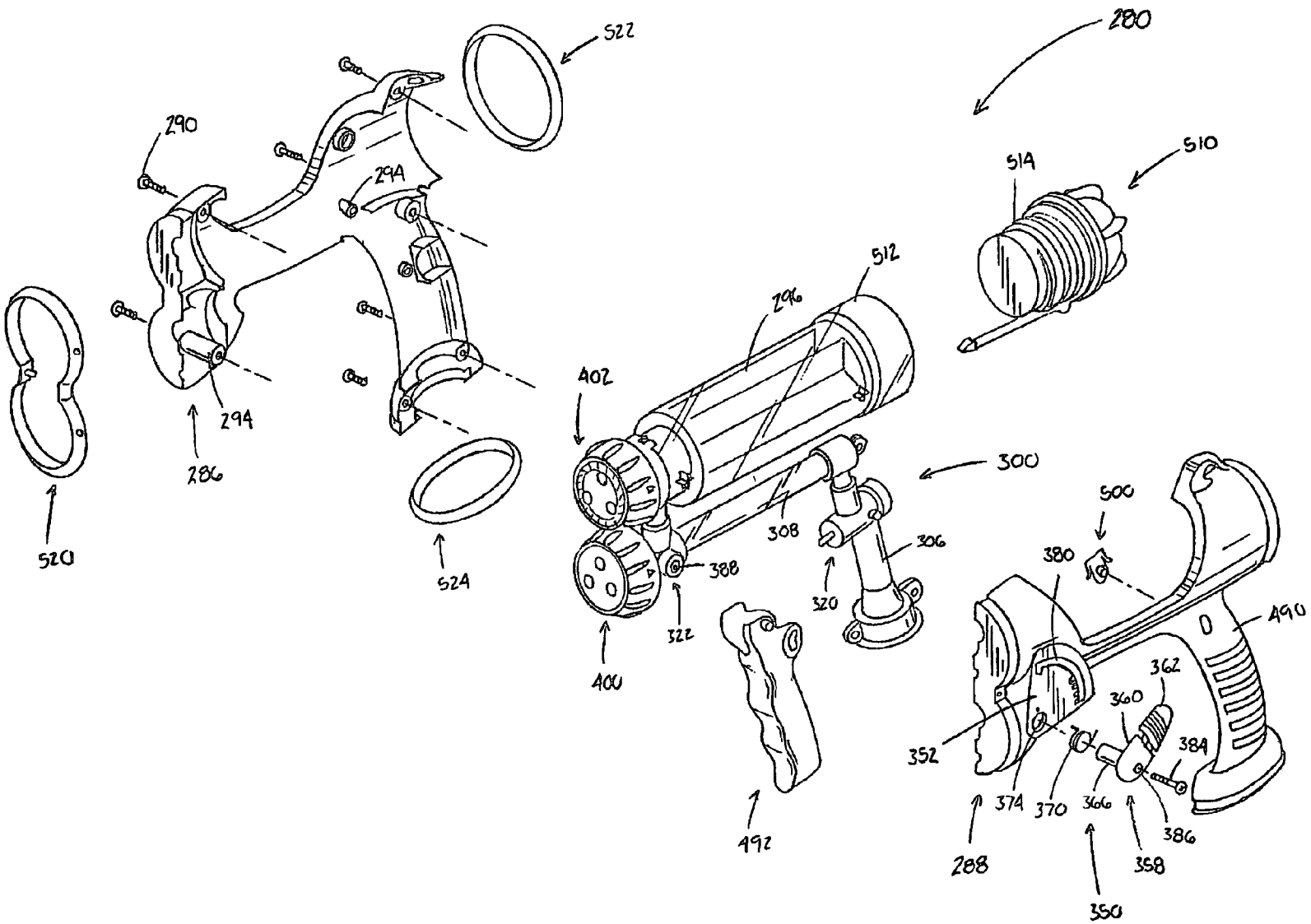
FIG. 12 is an exploded perspective view of the dual nozzle sprayer of FIG. 11.

With reference to FIGS. 11 and 12, dual nozzle sprayer 280 generally includes a body portion 282 having first and second halves 286 and 288 that may be secured together by suitable fasteners 290. In this embodiment, a plurality of first bosses 294 extend outwardly from the first housing half 286 which align with a plurality of second bosses (not shown) extending outwardly from the second housing half 288. Each corresponding first and second boss includes an aperture for receiving a fastener 290 which threadingly engages the apertures. The body portion is configured to house a mixing container 296 and a plumbing assembly 300 operably mounted to the mixing container.

Figure 13:
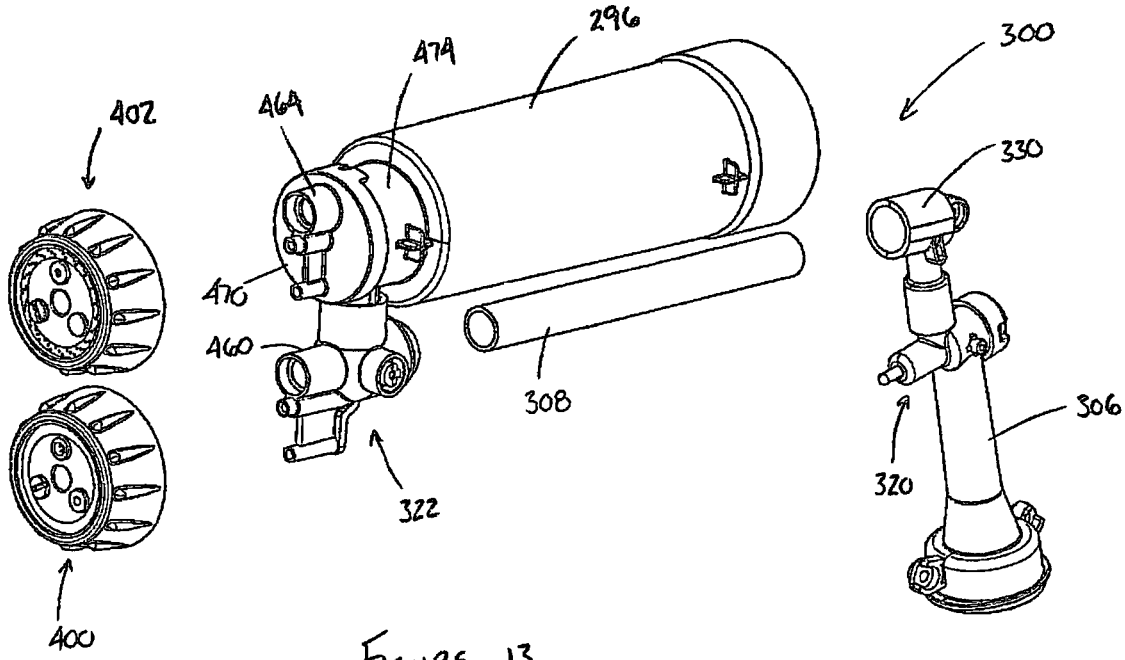
FIG. 13 is an exploded perspective view of a plumbing assembly and mixing container of the dual nozzle sprayer of FIG. 12.
Figure 14:
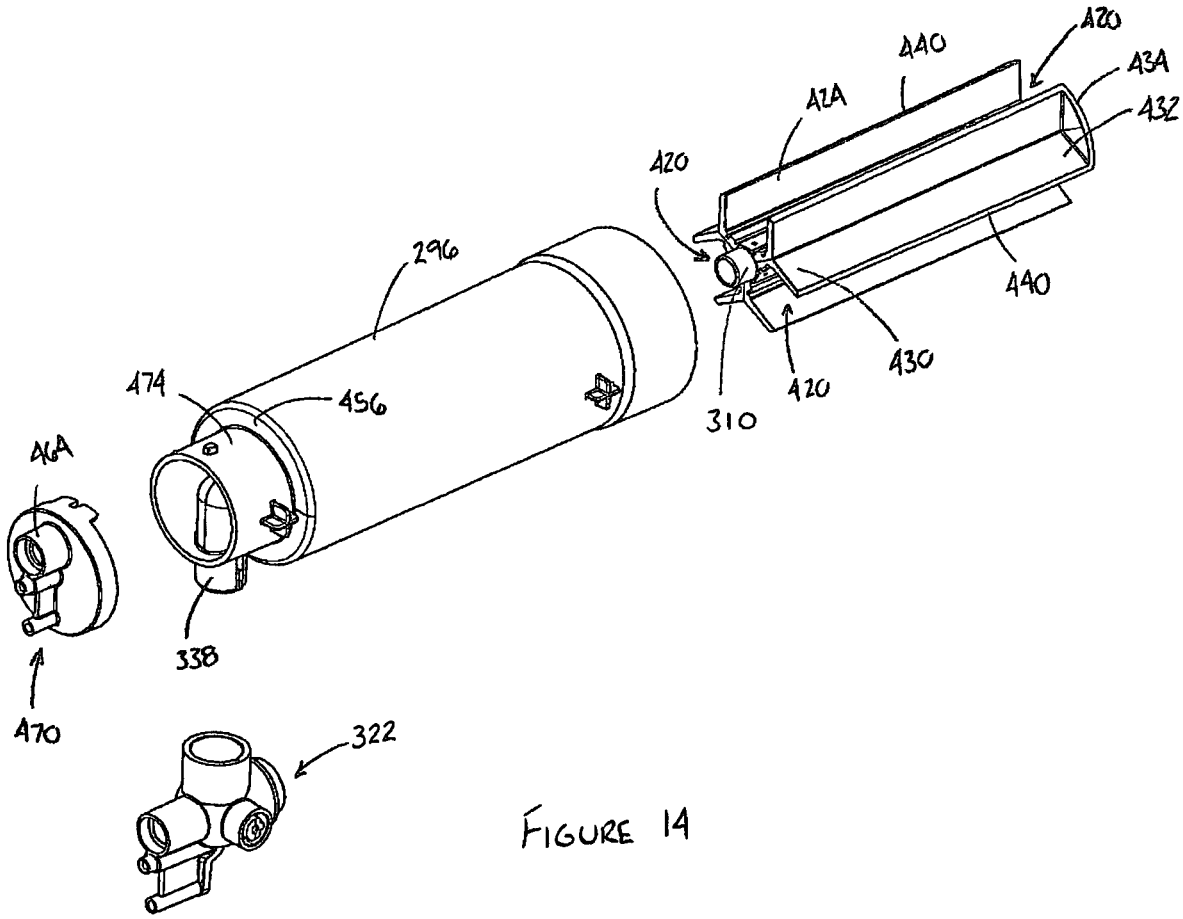
FIG. 14 is an exploded perspective view of the mixing container of FIG. 13.
Figure 15:
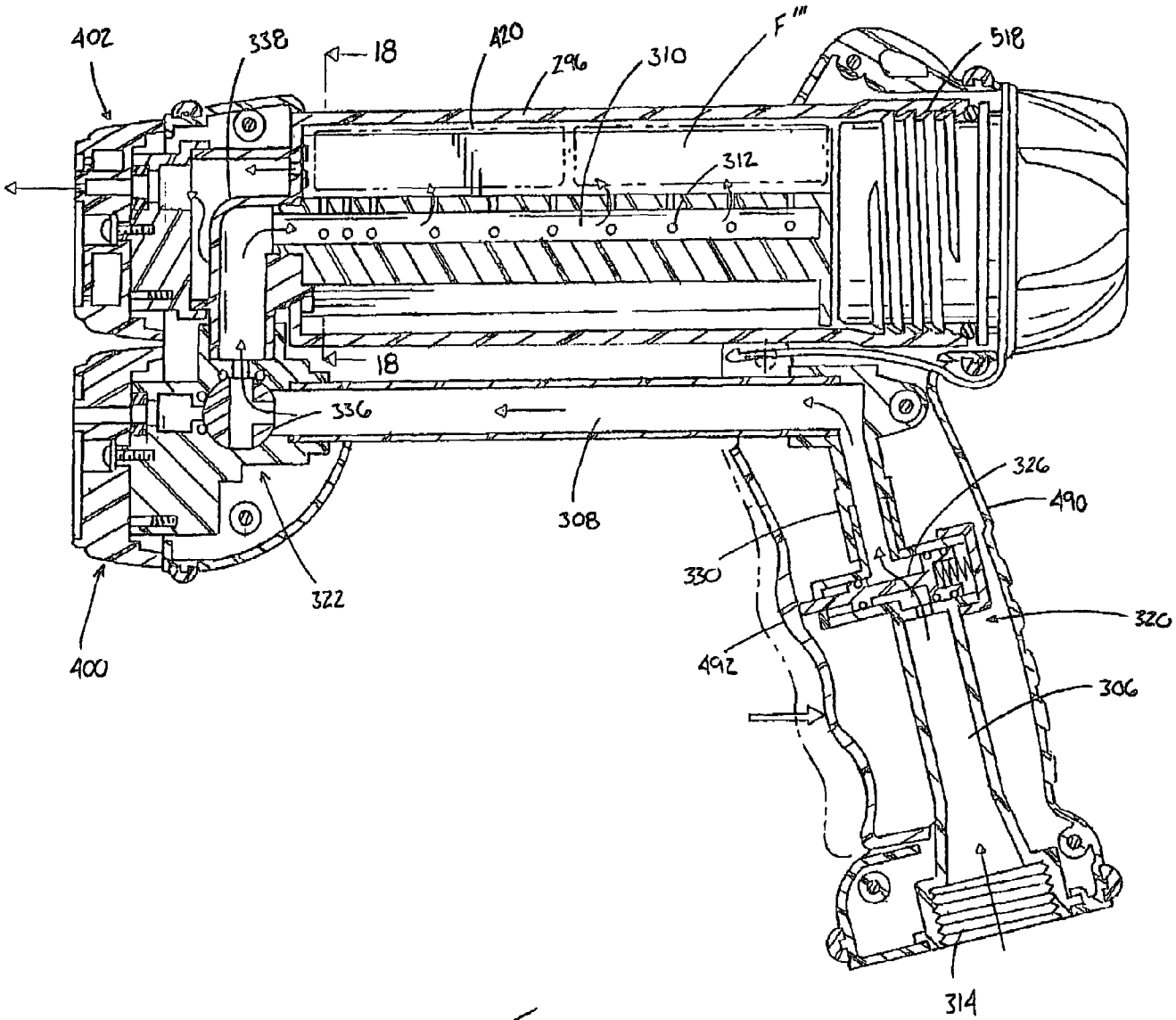
FIG. 15 is a side cross-sectional view of the dual nozzle sprayer of FIG. 11 illustrating a flow of pressurized water through the dual nozzle sprayer.

As best shown in FIGS. 13 and 14, the plumbing assembly 300 includes a first flow member 306, a second flow member 308 and a third flow member 310. The first flow member 306 defines a first flow passage having an inlet in fluid communication with a source of pressurized water, such as from a garden hose H'", and an outlet. The second flow member 308 defines a second flow passage and includes a water-only inlet in selective fluid communication with the first flow member outlet and a water-only outlet. The third flow member 310 defines a third flow passage and includes a water-only inlet in selective fluid communication with the second flow member outlet and at least one water-only outlet port 312. As shown in the embodiment of FIG. 15, the third flow member 310 includes a plurality of spaced apart water-only outlet ports 312 arrayed along a length of the third flow passage. To secure the dual nozzle sprayer 280 to the garden hose, the first flow member can include conventional attaching means such as the illustrated internal screw threads 314.

With additional reference to FIG. 15, the plumbing assembly 300 further includes a first valve assembly 320 and a multi-position second valve assembly 322. The first valve assembly, which can be mounted to the outlet of the first flow member 306, includes a first valve element 326 and a first conduit 330. The first conduit is mounted to the inlet of the second flow member 308. As is well know, the first valve element controls the flow of pressurized water through the second flow member.

The second valve assembly 322, which can be mounted to the outlet of the second flow member 308, selectively directs the pressured water to the inlet of the third flow member 310. The second valve assembly includes a second valve element 336 and a second conduit 338. The second conduit is mounted to the inlet of the third flow member 310. The second valve element can be a ball valve, butterfly valve, or valves of conical or cylindrical configuration; all of which are well known in the art. In the depicted embodiment, the second valve element is a ball valve. The second valve element is externally movable to various flow positions by a diverter assembly 350 mounted to a generally planar section 352 located on the second half 288 of the body portion 282 (FIG. 12). The second valve assembly allows the operator to regulate volume of water flow through the third flow member,310.

The diverter assembly 350 includes a lever 358 having a base portion 360 and a displaceable finger portion 362. The finger portion can include a contoured grip having an elastomeric coating for assisting a user in gripping the finger portion. The base portion includes a projection 366 dimensioned to receive a lever return spring 370 which is secured in an opening 374 located in the planar section 352. To mount the diverter assembly 350 to the body portion 282, the projection 366 is extended through the opening 374. A tab (not shown) extending from the finger portion 362 is positioned in a generally arcuate guide 380 located on the planar section 352. A fastener, such as a screw 384, is inserted through an opening 386 in the base portion 360 and threadedly engages an opening 388 located on the second valve assembly 322.

Figure 16:
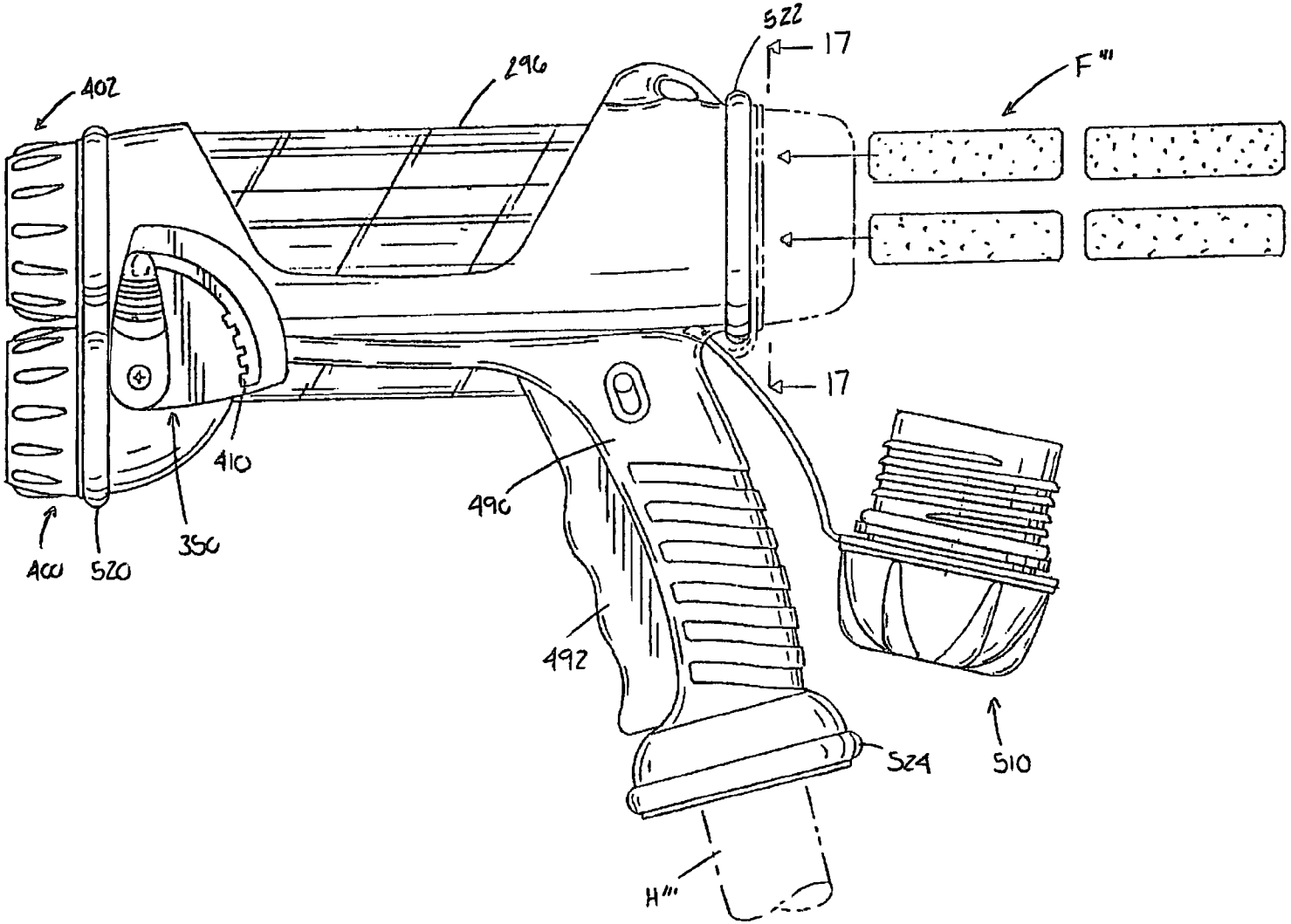
FIG. 16 is a side elevational view of the dual nozzle sprayer of FIG. 11 illustrating the insertion of a soluble product.

In use, the diverter assembly 350 moves the second valve element to a plurality of positions. In a water-only position, the lever is located at a lowermost end of the arcuate guide 380. In this position, the second valve element 366 directs the pressurized water flowing through the second flow passage into an inlet of a first spray pattern member or first flow adjustment nozzle 400. As the lever 358 is moved upwardly in the guide 380, the second valve element rotates, which, in turn, directs a portion of the pressurized water flowing through the second flow passage into the second conduit 338 and the third flow passage. In these intermediate positions (one being illustrated in FIGURE 11), water can flow through the first flow adjustment nozzle 400 and diluted product can flow through a second spray pattern member or second flow adjustment nozzle 402. The lever 358 can be locked in an intermediate position by moving the tab of the finger portion 362 into one of a plurality of spaced apart notches 410 located on the arcuate guide 380 (FIG. 16). In a diluted product-only position, the lever is located at an uppermost end of the arcuate guide 380 (FIG. 16). In this position, and as shown in FIG. 15, the second valve element 366 directs all the pressurized water flowing through the second flow passage into the third flow passage and into an inlet of the second flow adjustment nozzle 402. Thus, second valve assembly allows the operator to regulate volume of water flow through the third flow member 310.

Figure 17:
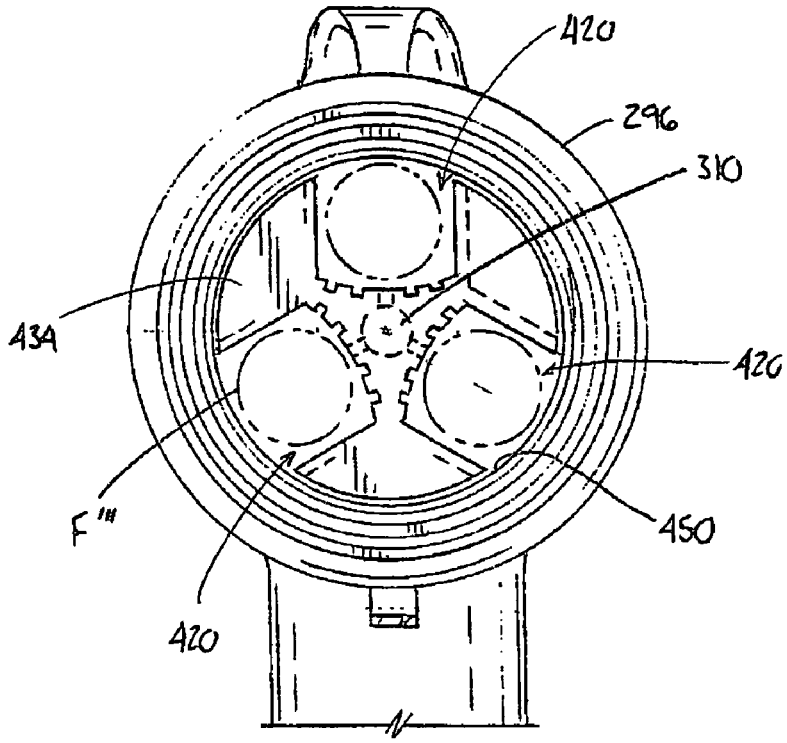
FIG. 17 is a cross-sectional view of the dual nozzle sprayer taken generally along the lines of 17-17 of FIG. 16.
Figure 18:
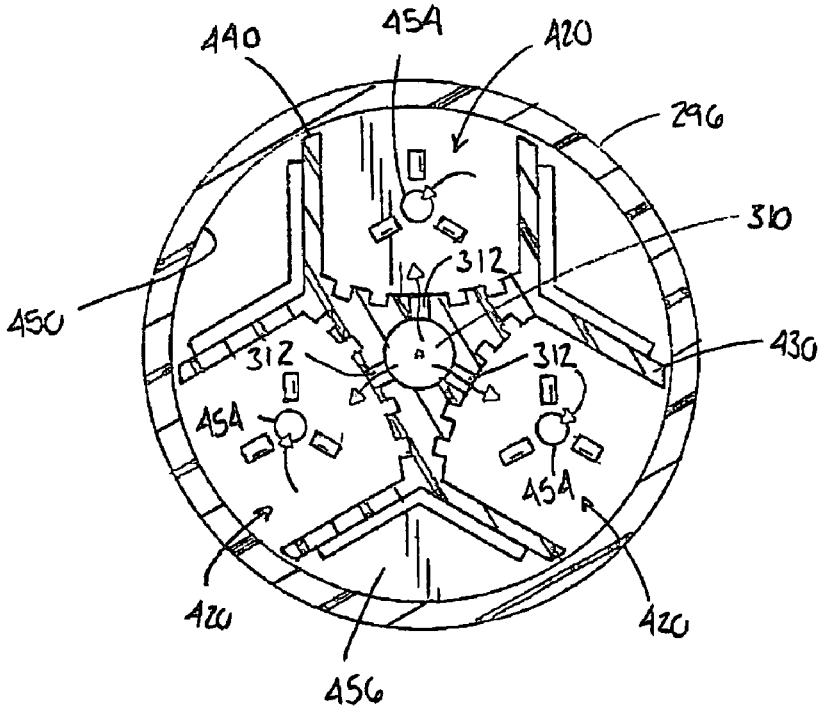
FIG. 18 is a cross-sectional view of the dual nozzle sprayer taken generally along the lines of 18-18 of FIG. 15.

With reference again to FIGS. 13-15, the mixing container 296, which has a longitudinal axis generally parallel to a longitudinal axis of said third flow passage, includes at least one channel 420 extending through the mixing chamber. In the depicted embodiment, the mixing chamber 296 includes three longitudinally extending channels 420 circumferentially spaced about the longitudinal axis of the third flow passage. Of course, more or less than three channels could be employed for the mixing container. Each channel is located between generally Y-shaped spines 424 extending outwardly from the third flow member 310. The spines are dimensioned to securely retain in each channel the product, such as the illustrated fertilizer F'''. The spines prevent the fertilizer from tumbling randomly within the mixing container, which, in turn, allows for more consistent dissolution times. Each spine includes an open first end 430, a second end 432 closed by an end wall 434, and longitudinal extending top edges 440. As shown in FIGS. 17 and 18, the end wall and top edges of each spine generally abut against an inner surface 450 of the mixing container 296.

As shown in FIGS. 15 and 18, each channel 420 of the mixing container 296 is in fluid communication with the water-only outlet ports 312 of the third flow member 310. The ports extend into the mixing container and direct the pressurized water flowing through the third flow passage into the channels of the mixing container. In particular, as pressurized water flows through the third flow passage of the third flow member 310, the outlet ports 312, which are arrayed along a length of each channel 420, direct the pressurized water into the channels. The outlet ports 312 act as water jets to evenly dissolve the fertilizer F" secured in the channels 420 at a substantially constant dissolution. Although dissolution time can vary at different water pressures, the dual nozzle sprayer 280 regulates itself to the varying water pressures to maintain the dissolution rate of the fertilizer. It should also be appreciated that the dissolution rate of the fertilizer inside the channels can be controlled via the addition and/or subtraction of the number of water outlet ports 312 into each channel 420.

As indicated above, the dual nozzle sprayer 280 includes the first flow adjustment nozzle 400 for spraying pressurized water and the second flow adjustment nozzle 402 for spraying diluted product. The first flow nozzle is in fluid communication with the outlet of the second flow member 308. As shown in FIG. 18, the second flow nozzle is in fluid communication with exhaust openings 454 located in an end wall 456 of the mixing container 296. As perhaps best illustrated in FIG. 13, the first flow nozzle can be mounted to an outlet pipe 460 extending from the first valve assembly 322. The second flow nozzle 402 can be mounted to an outlet pipe 464 extending from a nozzle adapter 470 secured to a flange 474 extending outwardly from the mixing container end wall 456. Each flow adjustment nozzle includes a plurality of flow outlets. It should be appreciated that by rotating the first and second flow adjustment nozzles 400, 402, the spray pattern of the flow of water-only or diluted product projecting through the nozzle outlets can be controlled.

Similar to the previous embodiments, and with reference again to FIGS. 11 and 12, the body portion 282 includes a generally hollow handle portion 490 which houses the first flow member 306. A trigger lever 492, which can have an elastomeric coating for assisting a user in gripping the handle portion 490, is mounted to a front section 494 of the handle portion. The handle portion 330 can also have a rubberized texture for operator comfort. As shown in FIG. 12, the trigger lever 492 is pivotally secured to the body portion 282 for actuating a first valve member 320 which controls the flow of water through the first flow member 306. For convenience, the handle portion can include a locking mechanism 500 operably connected to the trigger lever for maintaining the trigger lever in an actuated position.

The dual nozzle sprayer 280 further includes a cap 510 which can be attached to an open end portion 512 of the mixing container 296. The cap can contain an annular seal and is formed with external screw threads 514 for threadedly engaging complimentary internal screw threads 518 of the end portion. The cap allows the operator of the sprayer 280 to easily insert the soluble product into the channels 420 of the mixing container.

With continued reference to FIG. 12, a front bumper 520, a rear bumper 522 and a handle bumper 524 can be secured to the body portion 282 to protect the components of the dual nozzle sprayer.

A better understanding of the dual nozzle sprayer 280 as well as its unique features will be had by description of its operation. A source of water, such as from the garden hose H''', is connected to the first flow member 306. As shown in FIG. 17, the cap 510 is removed and a soluble product, such as the fertilizer F''', is positioned in the channels 420 of the mixing container 296. The cap is threadedly secured back onto the open end portion 512 of the mixing container. To spray the diluted product on a surface, the lever 358 of the diverter 350 is rotated thereby placing the second valve element 336 of the second valve assembly 322 in a diluted product-only position as more fully described above. As shown in FIG. 15, in this position, no water flows through the first flow adjustment nozzle 400. The sprayer 280 is held in the operator's hand by the handle portion 490 and the trigger lever 492 is then actuated to open the first valve element 326 of the first valve assembly 320 whereupon high pressure water passes through the first flow member 306, the second flow member 308 and into the third flow member 310. The pressurized water is then directed through the outlet ports 312 and into the channels 490. Again, the outlet ports, which act as water jets, evenly dissolve the fertilizer F''' secured in the mixing container 296. The diluted water is directed through the exhaust ports 454 located on the end wall 456 of the mixing container and flows out of the second spray nozzle 402. The concentration of the diluted product being sprayed can be controlled by turning the lever 358 of the diverter 250 as previously described.

As to a further discussion of the manner of usage and operation of the dual nozzle sprayer 280 for water-only spraying, the same should be apparent from the above description relative to the previous embodiments. Accordingly, no further discussion relating to the manner of usage and operation will be provided.

Typically, the components of the dual nozzle sprayer are made of a conventional polymer material. However, alternative materials, including metallic materials such as aluminum, and composite materials, such as carbon fiber reinforced resin material, can be used to form some of the components of the dual nozzle sprayer. It should also be appreciated that at least a portion of the second flow member of FIG. 7 and the mixing container of FIG. 11 can be transparent so as to allow the user to view the dissolution of the fertilizer.

It should be appreciated that dissolution rates of the soluble products are generally dependent on water temperature. As such, initial water from a hose is generally warmer (sometimes 88° F.) than "below ground" temperature (generally 56-56° F.). Thus, the fertilizer secured in the second flow member will be dissolved faster with the initial warmer water. However, the dissolution rate is more consistent after water temperature has stabilized to the below ground temperature. Although not illustrated, the dual nozzle sprayer can include a thermometer to indicate the temperature of the water flowing through the sprayer. For example, the dual nozzle sprayer can include a liquid crystal thermometer which changes color when water has reached a stable "below ground" temperature. Once this temperature is reached, the operator can then to dissolve the fertilizer.

As is evident from the foregoing, the present invention provides a dual nozzle sprayer which allows for the spraying of water-only, diluted product or possibly a combination of both. This is advantageous not only from a time saving standpoint but also from the standpoint of convenience where the sprayer may be used in a difficult to reach position. Again, the dual nozzle sprayer of the present invention has been illustrated for use in conjunction with the spraying of a fertilizer, however, it is obvious that other soluble products could be utilized.

The disclosure has been described with reference to the several embodiments. Obviously, modifications and alterations will occur to others upon reading and understanding the preceding detailed description. It is intended that the disclosure be construed as including all such modifications and alterations insofar as they come within the scope of the appended claims or the equivalents thereof.

What is claimed is:

1. A portable sprayer for applying a diluted associated product to a surface to be treated comprising:

a housing including:

an inlet for supplying pressurized water to said sprayer, a first water only outlet, and a second diluted product only outlet;

a mixing chamber within said housing, said mixing chamber dimensioned to securely hold the associated product, said mixing chamber in fluid communication with said second outlet;

a first flow passage extending through said housing, said first flow passage in selective fluid communication with said inlet and said first outlet; and a second flow passage extending through said housing, said second flow passage in selective fluid communication with said first flow passage and said mixing chamber, wherein a wall of said second flow passage is configured to direct the pressurized water flowing through said second flow passage into said mixing chamber to evenly dissolve the associated product and provide a generally consistent associated product to water ratio, wherein said mixing chamber has a longitudinal axis and said second flow passage has a longitudinal axis, wherein the longitudinal axis of said mixing chamber is spaced from and generally parallel to the longitudinal axis of said second flow passage.

2. The sprayer of claim 1, wherein said wall of said second flow passage includes at least one opening, said at least one opening extending into said mixing chamber, said at least one opening directing the pressurized water flowing through said second flow passage into said mixing chamber.

3. The sprayer of claim 1, wherein said wall of said second flow passage has a length and includes a plurality of openings for directing the pressurized water flowing through said second flow passage into said mixing chamber, said openings being arrayed along the length of said wall of said second flow passage.

4. The sprayer of claim 1, wherein a wall of said mixing chamber includes an exhaust port, said exhaust port being in fluid communication with said second outlet.

5. The sprayer of claim 1, wherein said housing and a wall of said mixing chamber form a plurality of channels for retaining the associated product, said plurality of channels extending through said mixing chamber.

6. The sprayer of claim 5, wherein said plurality of channels is circumferentially spaced about a longitudinal axis of said second flow passage.

7. The sprayer of claim 1, further comprising a manifold mounted in said housing, said manifold being adapted to direct a portion of the pressurized water flowing through said second flow passage to an inlet of said mixing chamber.

8. The sprayer of claim 7, wherein said manifold has at least one through bore, said bore having an inlet in fluid communication with said first flow passage and an outlet in fluid communication with said inlet of said mixing chamber.

9. The sprayer of claim 1, further comprising a valve operable to selectively flow pressurized water to at least one of said first outlet of said housing and said second outlet of said housing.

10. The sprayer of claim 9, wherein said valve includes a rotatable valve element, wherein when the rotatable valve element is in a first position, pressurized water flows through said first outlet of said housing, wherein when said rotatable valve element is in a second position, pressurized water flows through second outlet of said housing.

11. The sprayer of claim 9, further including a flow adjustment mechanism operably connected to said valve, wherein said flow adjustment mechanism regulates flow of pressurized water flow through said first housing outlet and said second housing outlet.

12. The sprayer of claim 1, further comprising a first spray pattern member and a second spray pattern member, each spray member being removably mounted to said housing, wherein said first spray pattern member is in fluid communication with said first flow passage and said second spray pattern member is in fluid communication with said second flow passage.

13. A portable sprayer for applying a diluted associated product to a surface to be treated comprising:

a mixing container including at least one channel configured to securely retain therein the associated product; and a plumbing assembly mounted to said mixing container including:

a first flow member defining a first flow passage having an inlet in fluid communication with a source of pressurized water and an outlet, a second flow member defining a second flow passage having an inlet in fluid communication with said outlet of said first flow passage and an outlet, and a third flow member defining a third flow passage having an inlet in fluid communication with said outlet of said second flow passage and at least one outlet port, said at least one outlet port extending into said mixing housing, said at least one outlet port directing the pressurized water flowing through said third flow passage into said at least one channel of said mixing housing to evenly dissolve the associated product at a substantially constant dissolution.

14. The sprayer of claim 13, wherein said third flow member extends longitudinally through said mixing container.

15. The sprayer of claim 14, wherein said mixing container includes a plurality of channels circumferentially spaced about a longitudinal axis of said third flow member.

16. The sprayer of claim 13, further comprising:

a first spray pattern member including an inlet in fluid communication with said outlet of said second flow member and an outlet for spraying pressurized water, and a second spray pattern member including an inlet in fluid communication with said at least one outlet port of said third flow member and an outlet for spraying diluted associated product.

17. The sprayer of claim 13, wherein said plumbing assembly includes:

a first valve assembly operable to selectively flow pressurized water from said outlet of said first flow member to said inlet of said second flow member, and a second valve assembly operable to selectively flow pressurized water from said outlet of said second flow member to said inlet of said third flow member.

18. A portable dual nozzle sprayer for applying a diluted associated product to a surface to be treated comprising:

a dilution housing including a plurality of channels, each channel configured to securely retain therein the associated product;

a plumbing assembly operably connected to said housing, said plumbing assembly including:

a first flow tube defining a first flow passage having an inlet in fluid communication with a source of pressurized water and an outlet, and a second flow tube defining a second flow passage having an inlet in fluid communication with said outlet of said first flow tube and a plurality of spaced apart outlet ports, each outlet port extending into one of said plurality of channels, each outlet port jetting the pressurized water flowing through said second flow passage into said plurality of channels to evenly dissolve the associated product;

a first spray pattern member in fluid communication with said outlet of said first flow tube for spraying pressurized water; and a second spray pattern member in fluid communication with said plurality of outlet ports of said second flow tube for spraying diluted associated product.

19. The sprayer of claim 18, further comprising a manifold mounted in said dilution housing, said manifold configured to direct a portion of the pressurized water flowing through said second flow passage to each housing channel.

* * * * *